US010512304B2

(12) United States Patent
Nussbaum et al.

(10) Patent No.: US 10,512,304 B2
(45) Date of Patent: Dec. 24, 2019

(54) LACE ADJUSTER WITH INTERCHANGEABLE COVERS

(71) Applicant: FLYCLIP LLC, New York, NY (US)

(72) Inventors: Jonathan Nussbaum, Miami, FL (US); Darren Wolfberg, New York, NY (US)

(73) Assignee: FLYCLIP LLC, Miami, FL (US)

( * ) Notice: Subject to any disclaimer, the term of this patent is extended or adjusted under 35 U.S.C. 154(b) by 252 days.

(21) Appl. No.: 14/434,924

(22) PCT Filed: Oct. 9, 2013

(86) PCT No.: PCT/US2013/064008
§ 371 (c)(1),
(2) Date: Apr. 10, 2015

(87) PCT Pub. No.: WO2014/058959
PCT Pub. Date: Apr. 17, 2014

(65) Prior Publication Data

US 2015/0250265 A1 Sep. 10, 2015

Related U.S. Application Data

(60) Provisional application No. 61/711,872, filed on Oct. 10, 2012.

(51) Int. Cl.
*A43C 7/08* (2006.01)
*A43C 11/24* (2006.01)
*A43C 7/00* (2006.01)

(52) U.S. Cl.
CPC ..... *A43C 7/08* (2013.01); *A43C 7/00* (2013.01); *A43C 11/24* (2013.01);
(Continued)

(58) Field of Classification Search
CPC .. A43C 7/08; A43C 11/24; A43C 7/00; Y10T 24/3713; Y10T 24/2708; Y10T 24/32; F16G 11/101
See application file for complete search history.

(56) References Cited

U.S. PATENT DOCUMENTS 3,473,198 A * 10/1969 Meier ..... A43B 3/30 24/712.3
3,908,238 A * 9/1975 Panicci ..... A43C 7/005 24/712.3

(Continued)

FOREIGN PATENT DOCUMENTS

CN 201718602 U 1/2011
CN 202197937 U 4/2012

(Continued)

OTHER PUBLICATIONS

The International Search Report and Written Opinion of the International Searching Authority, dated Feb. 26, 2014, FlyClip LLC, PCT/US13/64008. (related application).

(Continued)

*Primary Examiner* — Robert Sandy
*Assistant Examiner* — Louis A Mercado
(74) *Attorney, Agent, or Firm* — Roeder & Broder LLP; Steven G. Roeder

(57) ABSTRACT

A lace adjuster (14) includes an adjuster assembly (16); and a first cover (18) that is selectively attachable to the adjuster assembly (16). The first cover (18) is selectively movable between (i) an attached position, wherein the first cover (18) is attached to the adjuster assembly (16), and (ii) a detached position, wherein the first cover (18) is detached from the adjuster assembly (16). The first cover (18) can be moved between the attached position and the detached position without damaging the first cover (18) and the adjuster assembly (16). Additionally, the lace adjuster (14) can further include a second cover (18) that is alternatively, selectively attachable to the adjuster assembly (16).

20 Claims, 6 Drawing Sheets

(52) U.S. Cl.
CPC ..... *Y10T 24/2708* (2015.01); *Y10T 24/32* (2015.01); *Y10T 24/3713* (2015.01)

(56) References Cited

U.S. PATENT DOCUMENTS

| | | | | |
|---|---|---|---|---|
| 4,715,094 | A * | 12/1987 | Herdman | A43C 7/005 24/712.3 |
| 5,027,482 | A * | 7/1991 | Torppey | A43C 11/1493 24/306 |
| 5,718,021 | A * | 2/1998 | Tatum | A43C 7/005 24/712.2 |
| 7,722,219 | B2 | 5/2010 | Hartley | |
| 8,181,320 | B2 | 5/2012 | Wolfberg | |
| 8,782,860 | B2 * | 7/2014 | Rogers | A43C 7/005 24/329 |
| 2003/0121127 | A1 * | 7/2003 | Walker | A41D 20/00 24/306 |
| 2004/0172850 | A1 * | 9/2004 | King, Jr. | A43B 3/0031 36/50.1 |
| 2009/0173455 | A1 | 7/2009 | Hartley | |
| 2009/0223085 | A1 | 9/2009 | Wolfberg | |
| 2010/0018076 | A1 * | 1/2010 | Buck | A43B 3/105 36/88 |
| 2013/0255038 | A1 * | 10/2013 | Lai | A43B 3/0078 24/304 |
| 2016/0047403 | A1 * | 2/2016 | Cooley | A43C 11/24 24/712.5 |
| 2016/0066652 | A1 * | 3/2016 | Sandstedt | A43C 7/00 24/712.8 |

FOREIGN PATENT DOCUMENTS

| | | | |
|---|---|---|---|
| CN | 202566578 | U | 12/2012 |
| CN | 202566580 | U | 12/2012 |
| WO | WO2012162737 | A1 | 12/2012 |
| WO | 2014058959 | A1 | 4/2014 |

OTHER PUBLICATIONS

The International Preliminary Report on Patentability, dated Apr. 14, 2015, FlyClip LLC, PCT/US13/64008. (related application).
Office Action from the State Intellectual Property Office of China for application No. CN2013800039594 for Flyclip, LLC, dated Dec. 15, 2015. CN2013800039594 is related to present application. A brief summary of the Office Action in English from AFD China is also provided. Please contact the undersigned if you would like a full translation of the Office Action.

* cited by examiner

LACE ADJUSTER WITH INTERCHANGEABLE COVERS

RELATED APPLICATION

This application claims priority on U.S. Provisional Application Ser. No. 61/711,872, filed Oct. 10, 2012 and entitled "LACE ADJUSTER WITH INTERCHANGEABLE COVERS". As far as permitted, the contents of U.S. Provisional Application Ser. No. 61/711,872 are incorporated herein by reference.

BACKGROUND

It is often necessary to adjust, tighten, and untighten the shoelaces of a shoe. Unfortunately, currently available lace adjusters are typically drab or uninteresting in appearance.

SUMMARY

As provided herein, the present invention is directed toward a device including a cover that can be selectively attached to and detached from an assembly without damaging the cover and/or the assembly. Moreover, the device can be designed such that multiple, alternative covers can also be selectively attached to and detached from the assembly without damaging the covers and/or the assembly.

More particularly, in certain embodiments, the present invention is directed toward a lace adjuster comprising an adjuster assembly; and a first cover that is selectively attachable to the adjuster assembly. The lace adjuster can further comprise a second cover that is alternatively, selectively attachable to the adjuster assembly.

In one embodiment, the lace adjuster further comprises a light assembly including one or more lights that are positioned substantially adjacent to the first cover. In such embodiment, power can be selectively provided to the light assembly so that at least one or more of the lights generates light that is directed away from the adjuster assembly.

Additionally, in certain embodiments, the lace adjuster further comprises a cover attachment assembly that selectively attaches the first cover to the adjuster assembly. Further, in some such embodiments, the cover attachment assembly includes a first attachment member that is secured to the adjuster assembly and a second attachment member that is secured to the first cover. In such embodiments, the first attachment member engages the second attachment member when the first cover is in an attached position, and the first attachment member does not engage the second attachment member when the first cover is in a detached position. In one such embodiment, the cover attachment assembly includes a snap. In another such embodiment, the cover attachment assembly includes hook and loop material. Still alternatively, the cover attachment assembly can include a plurality of cover pins and a plurality of cover apertures that receive the plurality of cover pins. In one embodiment, the first cover includes the plurality of pins and the adjuster assembly includes the plurality of cover apertures.

Further, in one embodiment, the first cover includes a design that is positioned along a top surface of the cover.

The present invention is further directed toward a shoe comprising a shoe body, a shoe lace that is coupled to the shoe body, and the lace adjuster as described above that selectively adjusts the shoe lace.

Additionally, the present invention is also directed toward a lace adjuster for use with a shoe lace of a shoe, the lace adjuster comprising an adjuster assembly that adjusts the shoe lace; and a first cover that is selectively movable between (i) an attached position, wherein the first cover is attached to the adjuster assembly, and (ii) a detached position, wherein the first cover is detached from the adjuster assembly. In one embodiment, the first cover is movable between the attached position and the detached position without damaging the first cover and the adjuster assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

As provided herein, the present invention is directed toward a device including a cover that can be selectively attached to and detached from an assembly without damaging the cover and/or the assembly. Moreover, the device can be designed such that multiple, alternative covers can also be selectively attached to and detached from the assembly without damaging the covers and/or the assembly. It should be noted that although the present invention is described in particular herein in relation to use as part of a lace adjuster, that is merely just one potential use for the present invention, and the present invention can be designed for alternative uses as well. For example, the concept of alternative, selectively attachable (and detachable) covers as disclosed herein can also be utilized for various other suitable purposes or with other suitable devices. Additionally, the cover(s) itself can also be utilized individually for certain alternative purposes. For example, the cover(s) can be used as a golf ball marker, or for other suitable purposes.

Figure 1:
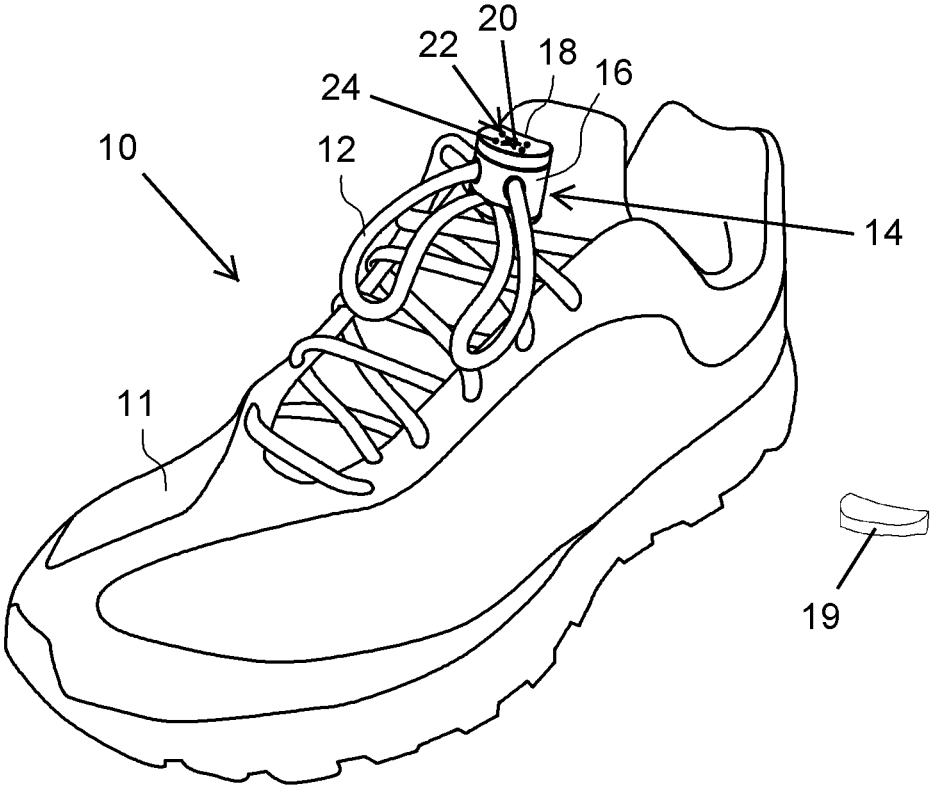
FIG. 1 is a perspective view of a shoe including a shoe body, a shoe lace, and a lace adjuster having features of the present invention.

FIG. 1 is a perspective view of a shoe 10 including a shoe body 11, a shoe lace 12 that is coupled to the shoe body 11, and a lace adjuster 14 having features of the present invention. The shoe 10, e.g., the shoe body 11 and the shoe lace 12, can have any suitable design, shape and/or size to meet the specific desires and requirements of the user. As illustrated in FIG. 1, the shoe 10 is an athletic-type shoe that can be used for running, walking, or any other chosen activity.

The design of the lace adjuster 14 can be varied to suit the specific requirements of the shoe 10 and/or the user of the shoe 10. In the embodiment illustrated in FIG. 1, the lace adjuster 14 includes an adjuster assembly 16 and a cover 18.

As an overview, the present invention is directed toward a lace adjuster 14 including an adjuster assembly 16, and a cover 18 that is selectively attachable to the adjuster assembly 16. Stated in another manner, the cover 18 is selectively movable between an attached position, wherein the cover 18 is attached to the adjuster assembly 16, and a detached position, wherein the cover 18 is detached from the adjuster assembly 16. More particularly, as described herein below, the lace adjuster 14 is uniquely designed such that multiple covers 18, e.g., the cover 18 and a second cover 19, can be alternatively, selectively attached to the adjuster assembly 16, without damaging the adjuster assembly 16 and/or the covers 18, 19. Further, additional covers 18, 19 can be sold separately that are also selectively attachable to the adjuster assembly 16. In some embodiments, each cover 18, 19 can include a design 20 that supports a particular team (e.g., a team logo), promotes an occasion, supports a cause, etc., or the design 20 can include any other desired decorative appearance. Thus, the appearance of the lace adjuster 14 can be changed as desired depending on the team, occasion, cause, etc. that the user wishes to support at any given time, or to provide any desired decorative appearance for the user.

Moreover, in certain embodiments, the lace adjuster 14 can further include a light assembly 22 including one or more lights 24, e.g., LED lights, that are mounted on and/or positioned substantially adjacent to the cover 18. In particular, the lights 24 can be coupled to the cover 18 and/or can be positioned such that the lights 24 can shine and/or extend through one or more light apertures (not shown) in the cover 18. Such lights 24 can also be positioned so as to more effectively and dramatically draw attention to the design 20 on the cover 18. Additionally and/or alternatively, the light assembly 22, i.e. the lights 24, can be positioned in a different area of the lace adjuster 14.

Certain non-exclusive representative embodiments of a suitable adjuster assembly 16 can be found in U.S. Pat. No. 8,181,320, issued on May 22, 2012 and entitled "LACE ADJUSTER". As far as permitted, the contents of U.S. Pat. No. 8,181,320 are incorporated herein by reference.

Figure 2B:
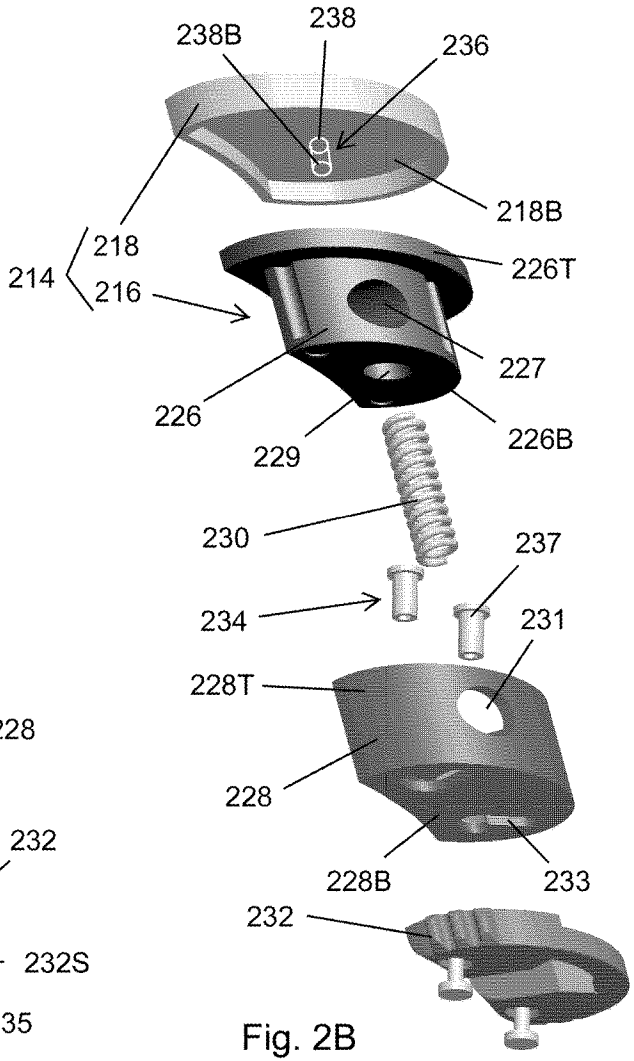
FIG. 2B is another exploded perspective view of the lace adjuster of FIG. 2A.
Figure 2A:
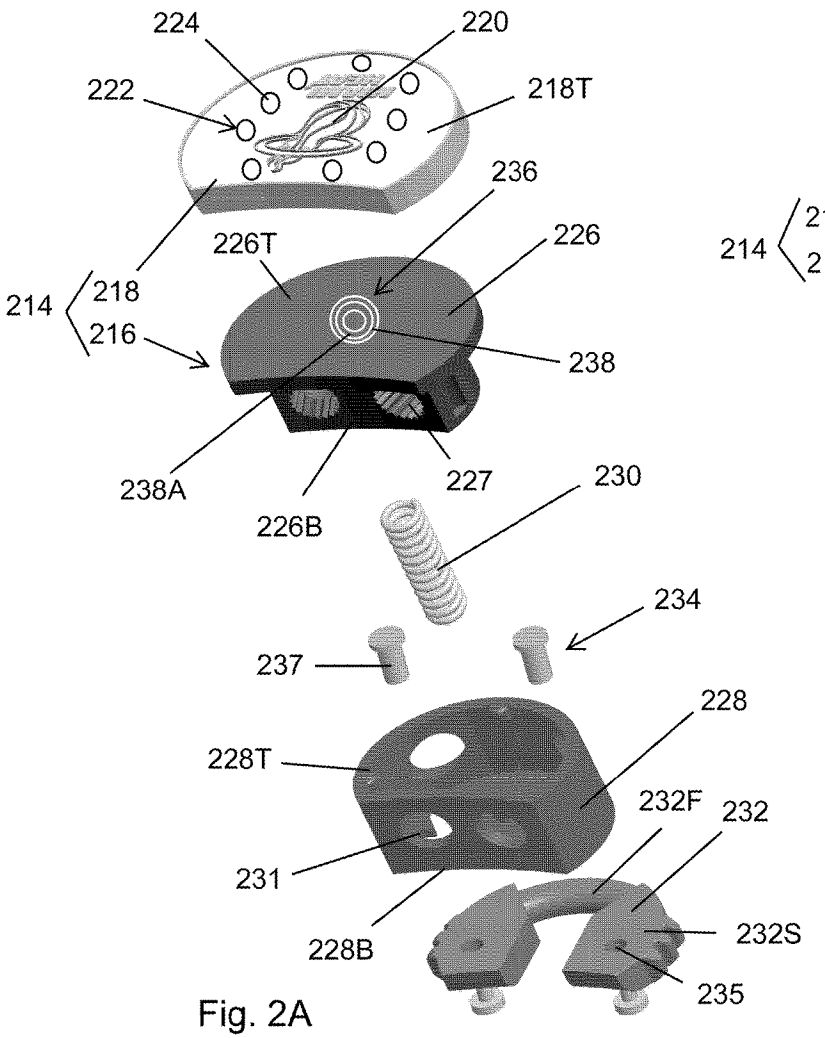
FIG. 2A is an exploded perspective view of an embodiment of a lace adjuster having features of the present invention.

FIG. 2A is an exploded perspective view of an embodiment of a lace adjuster 214 having features of the present invention. Additionally, FIG. 2B is another exploded perspective view of the lace adjuster 214 of FIG. 2A. The design of the lace adjuster 214 can be varied. In this embodiment, the lace adjuster 214 includes an adjuster assembly 216 and a cover 218 that can be selectively attached to and detached from the adjuster assembly 216 without damaging the adjuster assembly 216 and/or the cover 218.

In the embodiment illustrated in FIGS. 2A and 2B, the adjuster assembly 216 includes (i) an inner frame 226, (ii) an outer frame 228, (iii) a resilient member 230, (iv) a bracket 232, and (v) an attachment system 234 that cooperate with one another to enable a user to quickly and easily tighten or loosen the shoe lace 12 (illustrated in FIG. 1) of the shoe 10 (illustrated in FIG. 1). The design and positioning of each of the components of the adjuster assembly 216 can be varied. Additionally, the adjuster assembly 216 can be designed without one or more of the components as listed above.

In certain embodiments, the inner frame 226 fits partly within and moves up and down relative to the outer frame 228. The design and positioning of the inner frame 226 can be varied depending on the requirements of the adjuster assembly 216 and/or the lace adjuster 214. In this embodiment, the inner frame 226 includes an inner frame top 226T, and an inner frame bottom 226B that extends in a generally downward direction away from the inner frame top 226T. Additionally, the inner frame bottom 226B includes a plurality of inner frame apertures 227 that are adapted to receive the shoe lace 12 (illustrated in FIG. 1) and a member aperture 229 (illustrated in FIG. 2B) that is adapted to receive the resilient member 230.

In one embodiment, each of the inner frame top 226T and the inner frame bottom 226B can have a cross-section that is substantially semi-circular shaped. Alternatively, the inner frame top 226T and/or the inner frame bottom 226B can have a cross-section with a different shape. For example, the inner frame top 226T and/or the inner frame bottom 226B can have a cross-section that is substantially circular disc shaped, substantially square disc shaped, substantially rectangular disc shaped, or another suitable shape.

Additionally, in certain embodiments, the outer frame 228 is designed to receive at least a portion of the inner frame 226 and to allow the inner frame 226 to move up and down over a movement range relative to the outer frame 228. The design and positioning of the outer frame 228 can be varied depending on the requirements of the adjuster assembly 216 and/or the lace adjuster 214. In this embodiment, the outer frame 228 includes an outer frame base 228B, and an outer frame top 228T that extends in a generally upward direction away from the outer frame base 228B. Additionally, the outer frame top 228T includes a plurality of outer frame apertures 231 that are adapted to receive the shoe lace 12. Further, the outer frame base 228B includes a pair of attacher slots 233 (illustrated in FIG. 2B).

In one embodiment, each of the outer frame base 228B and the outer frame top 228T can have a cross-section that is substantially semi-circular shaped. Alternatively, the outer frame base 228B and/or the outer frame top 228T can have a cross-section with a different shape. For example, the outer frame base 228B and/or the outer frame top 228T can have a cross-section that is substantially circular disc shaped, substantially square disc shaped, substantially rectangular disc shaped, or another suitable shape.

The attacher slots 233 extend through the outer frame base 228B, and the attacher slots 233 form a portion of the attachment system 234. As illustrated, the attacher slots 233 can be somewhat "L" shaped, and the attacher slots 233 can be positioned substantially symmetrically within the outer frame base 228B.

In certain embodiments, the inner frame 226 and the outer frame 228 are designed to move relative to each other between a locked configuration and an unlocked configuration. In the unlocked configuration, the inner frame apertures 227 are substantially aligned with and concentric with the outer frame apertures 231. In the locked configuration, the inner frame 226 extends somewhat away from the outer frame 228, and the inner frame apertures 227 are positioned so that they are not aligned with or concentric with the outer frame apertures 231.

The design of the resilient member 230 can be varied depending on the requirements of the adjuster assembly 216 and/or the lace adjuster 214. For example, in the embodiment illustrated in FIGS. 2A and 2B, the resilient member 230 is a spring. Alternatively, the resilient member 230 can be another piece of resilient material. The resilient member 230 is secured to the inner frame 226 and the outer frame 228 and extends between the inner frame 226 and the outer frame 228. More particularly, the resilient member 230 is secured to and extends between the inner frame top 226T and the outer frame base 228B. Additionally, the resilient member 230 extends through the member aperture 229 in the inner frame bottom 226B. In this embodiment, the resilient member 230 urges the inner frame 226 up and/or away relative to the outer frame 228. Alternatively, the resilient member 230 can be designed to urge the inner frame 226 within the outer frame 228.

In some embodiments, the bracket 232 is secured to the outer frame 228, and the bracket 232 is designed to move (e.g., slide) relative to the outer frame 228 between a closed configuration and an open configuration. The design and positioning of the bracket 232 can be varied depending on the requirements of the adjuster assembly 216 and/or the lace adjuster 214. In this embodiment, the bracket 232 includes: (i) a front section 232F; (ii) a pair of side sections 232S; and (iii) a pair of attacher apertures 235.

When the bracket 232 is in the closed configuration, the bracket 232 is positioned substantially directly beneath the outer frame 228. Additionally, when the bracket 232 is in the open configuration, the bracket 232 is positioned somewhat beneath the outer frame 228, but it also extends forward away from the outer frame 228. The movement of the bracket 232 from the closed configuration to the open configuration is somewhat similar to the movement seen when a cash register drawer is opened.

The front section 232F of the bracket 232 is substantially arc-shaped and is positioned somewhat between the pair of side sections 232S and is connected to each of the side sections 232S. The front section 232F can be made from a relatively thin and flexible material that allows the side sections 232S to flex toward each other when pressure is applied on the outer edges of the side sections 232S. Additionally, the front section 232F is slightly shorter than the side sections 232S, so as to define a gap (not shown) between the bracket 232 and the outer frame 228, which, in turn, enables a portion of the shoe lace 12 to be secured within the gap between the bracket 232 and the outer frame 228 when the bracket 232 is in the closed configuration.

In one embodiment, each side section 232S includes one of the pair of attacher apertures 235. The attacher apertures 235 form a portion of the attachment system 234. The design and positioning of the attacher apertures 235 can be varied. As illustrated, the attacher apertures 235 are substantially circular and are adapted to be positioned beneath a portion of the attacher slots 233 on the outer frame base 228B.

Additionally, in one embodiment, the attachment system 234 is designed to slidably attach the bracket 232 to the outer frame 228. Alternatively, the attachment system 234 can be designed to slidably attach the bracket 232 to the inner frame 226.

In this embodiment, the attachment system 234 includes the attacher slots 233 that extend through the outer frame base 228B, the attacher apertures 235 that extend through the side sections 232S of the bracket 232, and a pair of attachment pins 237 that extend through the attacher slots 233 and the attacher apertures 235.

As discussed above, in this embodiment, the outer frame base 228B includes the pair of spaced apart, somewhat "L" shaped attacher slots 233, and the side sections 232S of the bracket 232 include the pair of substantially circular shaped attacher apertures 235, wherein each of the attacher apertures 235 correspond to one of the attacher slots 233. Further, each of the pair of attachment pins 237 extend through a corresponding attacher aperture 235 in the bracket 232 and into one of the attacher slots 233 in the outer frame base 228B. The attachment pins 237 are designed to fit snugly within the attacher apertures 235, and the attachment pins 237 are designed to slide within the attacher slots 233. With this design, the attachment pins 237 attach the bracket 232 to the outer frame 228, and the attachment pins 237 and the bracket 232 can slide relative to the outer frame 228 along the attacher slots 233.

While the bracket 232 is in the open configuration, a portion of the shoe lace 12 can easily be inserted into or removed from the gap between the bracket 232 and the outer frame 228. Subsequently, while the bracket 232 is in the closed configuration, a portion of the shoe lace 12 can be effectively clamped within the gap between the bracket 18 and the outer frame 14.

In summary, in this embodiment, (i) the inner frame 226 fits partly within and moves up and down relative to the outer frame 228 between the locked configuration and the unlocked configuration; (ii) the resilient member 230 extends between the inner frame 226 and the outer frame 228 and urges the inner frame 226 upward; (iii) the inner frame 226 includes the plurality of inner frame apertures 227; (iv) the outer frame 228 includes the plurality of outer frame apertures 231; (v) the inner frame apertures 227 are substantially aligned with and concentric with the outer frame apertures 231 when the inner frame 226 and the outer frame 228 are in the unlocked configuration, thereby allowing the shoe lace 12 to be threaded through the inner frame apertures 227 and the outer frame apertures 231; (vi) the inner frame apertures 227 are not aligned with and concentric with the outer frame apertures 231 when the inner frame 226 and the outer frame 228 are in the locked configuration, thereby allowing the shoe lace 12 to be held securely between the inner frame 226 and the outer frame 228; (vii) the bracket 232 is attached to and slides relative to the outer frame 228 via the attachment system 234 between the open configuration and the closed configuration; (viii) a portion of the shoe lace 12 can be easily inserted into and/or removed from the gap between the bracket 232 and the outer frame 228 when the bracket 232 is in the open configuration; and (ix) a portion of the shoe lace 12 can be securely held within the gap between the bracket 232 and the outer frame 228 when the bracket 232 is in the closed configuration.

As illustrated, the cover 218 can be substantially semi-circular disc shaped, and can be very similar to the shape of the top side of the inner frame 226. Alternatively, the cover 218 can be designed with a different shape from that shown in FIGS. 2A and 2B. For example, the cover 218 can be substantially circular disc shaped, substantially square disc shaped, substantially rectangular disc shaped, or another suitable shape.

Additionally, as provided above, the cover 218 can be selectively attached to and detached from the adjuster assembly 216, e.g., attached to and detached from the inner frame 226 of the adjuster assembly 216 in this particular embodiment. More particularly, the lace adjuster 214 can include a cover attachment assembly 236 that enables the cover 218 to be selectively attached to and detached from the adjuster assembly 216.

The design of the cover attachment assembly 236 can be varied. Stated in another manner, in alternative embodiments, the cover 218 can be selectively attached to the adjuster assembly 216 in any suitable manner. In certain embodiments, the cover attachment assembly 236 can include a first attachment member 238A (shown in FIG. 2A) that can be included with and/or coupled to a portion of the adjuster assembly 216, e.g., to the inner frame 226, and a second attachment member 238B (shown in FIG. 2B) that can be included with and/or coupled to the cover 218. The first attachment member 238A and the second attachment member 238B can be designed to selectively engage one another when being moved from a detached position to an attached position. Stated in another manner, when the cover 218 is in the attached position, the first attachment member 238A engages the second attachment member 238B; and when the cover 218 is in the detached position, the first attachment member 238A does not engage the second attachment member 238B.

For example, in the embodiment illustrated in FIGS. 2A and 2B, the cover attachment assembly 236 can comprise one or more snaps 238 (only one is shown in the Figures), with the first attachment member 238A of the snap 238 being secured to the adjuster assembly 216, e.g., to the inner frame 226 of the adjuster assembly 216, and the second attachment member 238B of the snap 238 being secured to the cover 218, i.e. to a bottom surface 218B of the cover 218. As noted above, the first attachment member 238A of the snap 238 and the second attachment member 238B of the snap 238 can selectively engage one another when being moved from the detached position to the attached position. Alternatively, the cover 218 can be selectively attached to and detached from the adjuster assembly 216 in another manner, such as with hook and loop material (e.g., Velcro), pin/aperture combinations, magnets, two-sided tape, lip/groove combinations, bumps/indentations combinations, or any other suitable manner.

Additionally, as illustrated in FIG. 2A, the cover 218 can include a design 220, e.g., a sports logo as shown in this embodiment, on a top surface 218T of the cover 218 that enables the lace adjuster 214 to have a more interesting appearance.

Further, in some embodiments, the lace adjuster 214 can also include a light assembly 222 including one or more lights 224, e.g., LED lights. In one embodiment, the lights 224 are secured to the cover 218 and are positioned about the design 220 to draw more attention to the design 220. Alternatively, the lights 224 can be positioned on or within the lace adjuster 214 in a different manner, and/or the lights 224 can be positioned away from or without a corresponding design 220. The light assembly 222 can selectively receive power e.g., from a power source, so that light from at least one of the one or more lights 224 is directed away from the lace adjuster 214.

Figure 2C:
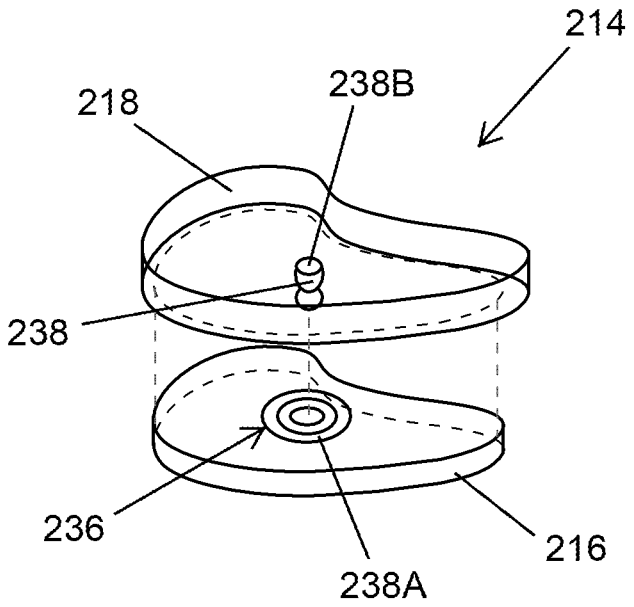
FIG. 2C is a perspective view of a portion of the lace adjuster of FIG. 2A.

FIG. 2C is a perspective view of a portion of the lace adjuster 214 illustrated in FIG. 2A. In particular, FIG. 2C illustrates the cover 218, a portion of the adjuster assembly 216, and the cover attachment system 236, i.e. the first attachment member 238A and the second attachment member 238B of the snap 238, that selectively attaches the cover 218 to the adjuster assembly 216. It should be noted that the design 220 and the light assembly 222 have been omitted in FIG. 2C for purposes of clarity.

Figure 3B:
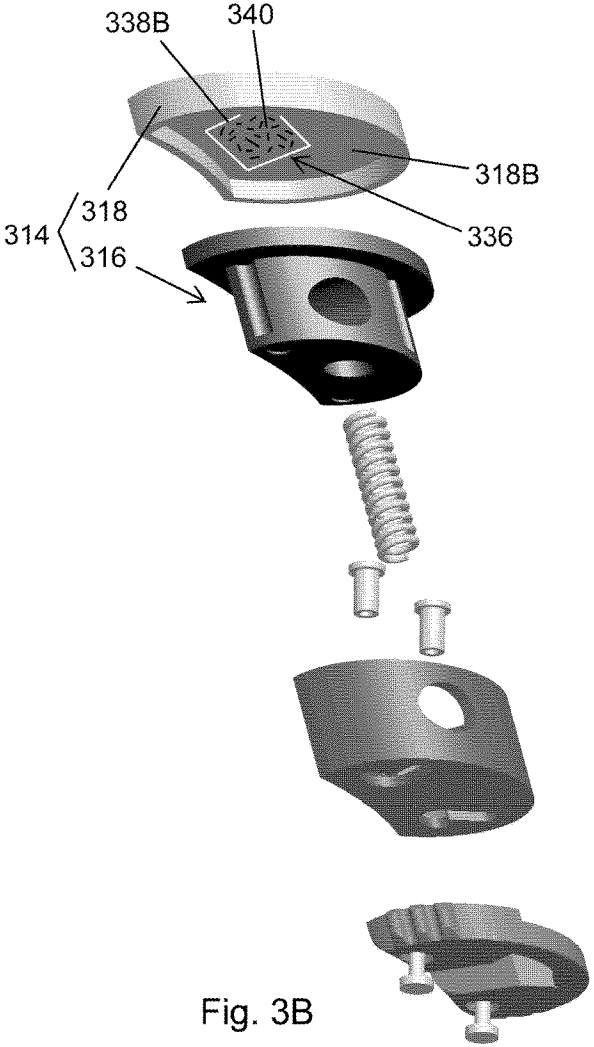
FIG. 3B is another exploded perspective view of the lace adjuster of FIG. 3A.
Figure 3A:
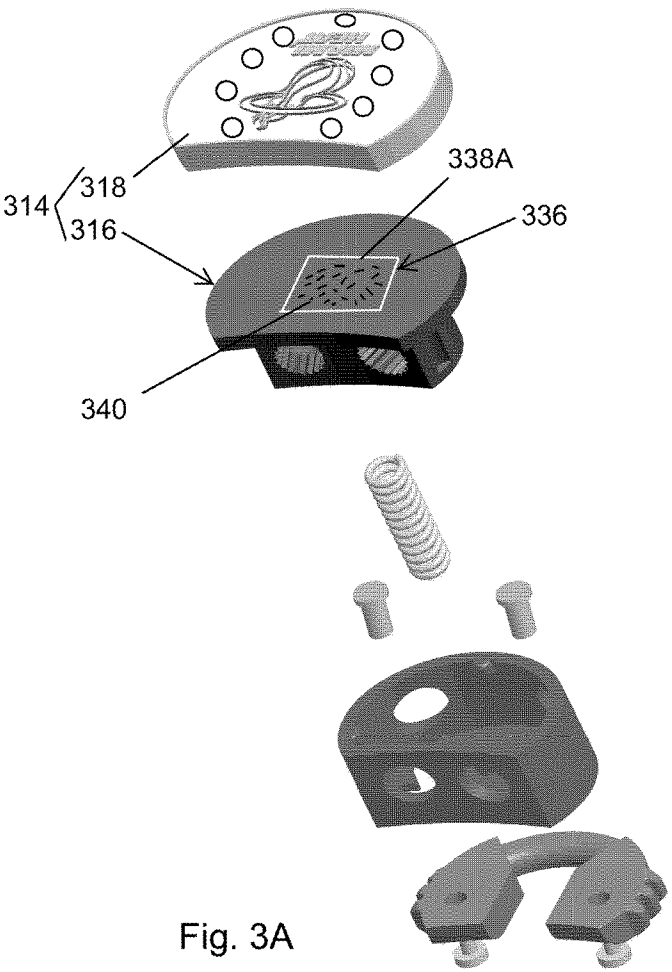
FIG. 3A is an exploded perspective view of another embodiment of a lace adjuster having features of the present invention.

FIG. 3A is an exploded perspective view of another embodiment of a lace adjuster 314 having features of the present invention. Additionally, FIG. 3B is another exploded perspective view of the lace adjuster 314 of FIG. 3A. The design of the lace adjuster 314 is substantially similar to the lace adjuster 214 illustrated and described above in relation to FIGS. 2A and 2B. For example, the lace adjuster 314 includes an adjuster assembly 316 and a cover 318 that are substantially similar to the adjuster assembly 216 and the cover 218 illustrated and described above in relation to FIGS. 2A and 2B.

However, in this embodiment, the cover attachment assembly 336 has a different design. In particular, in this embodiment, each of the first attachment member 338A (shown in FIG. 3A), which is included with and/or coupled to a portion of the adjuster assembly 316, and the second attachment member 338B (shown in FIG. 3B), which is included with and/or coupled to the cover 318, i.e. to a bottom surface 318B of the cover 318, include hook and loop material 340. The hook and loop material 340 of each of the first attachment member 338A and the second attachment member 338B are designed to engage one another such that the cover 318 can be selectively attached to and detached from the adjuster assembly 316 without damaging the adjuster assembly 316 and/or the cover 318.

Figure 4A:
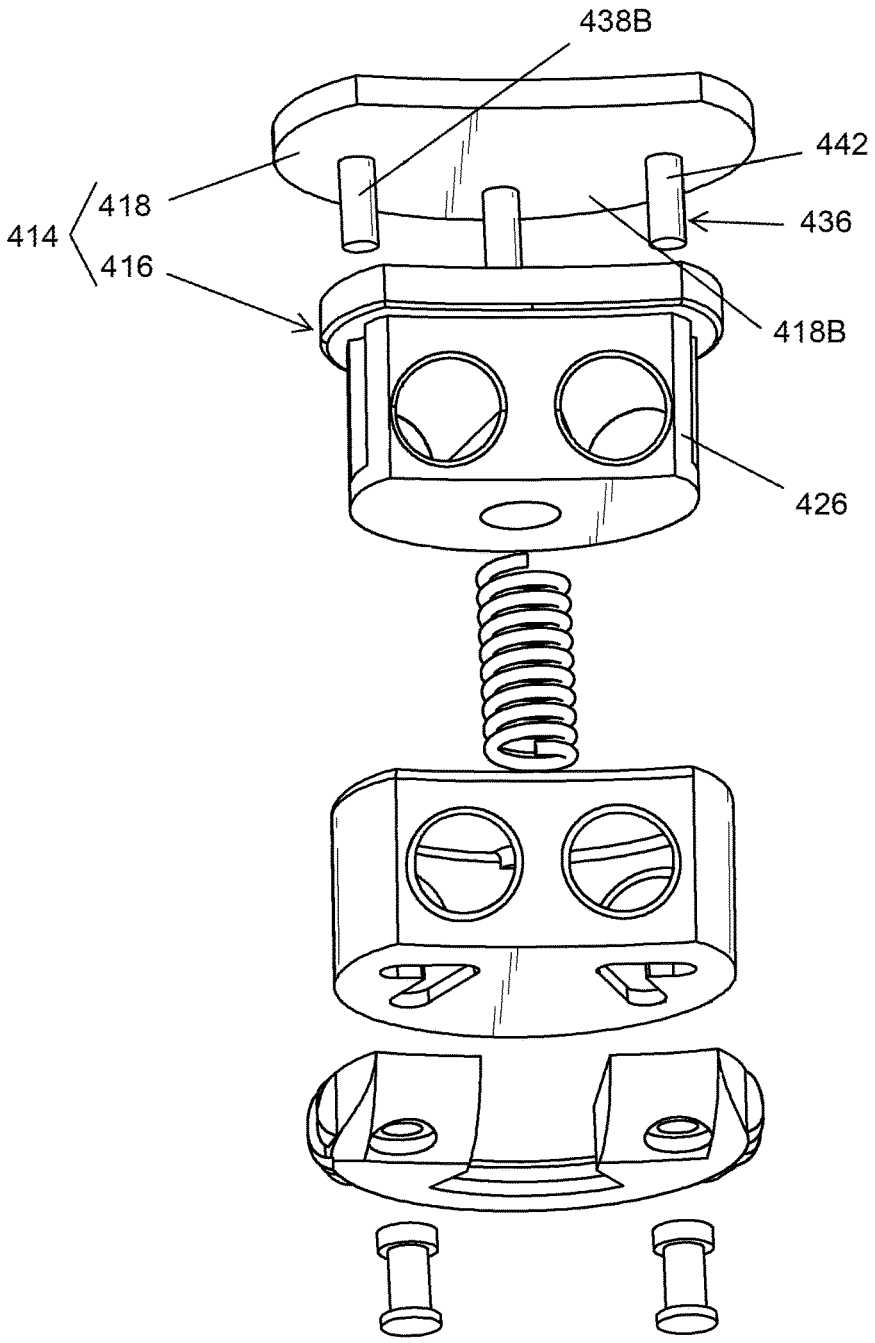
FIG. 4A is an exploded perspective view of a still another embodiment of a lace adjuster having features of the present invention.
Figure 4B:
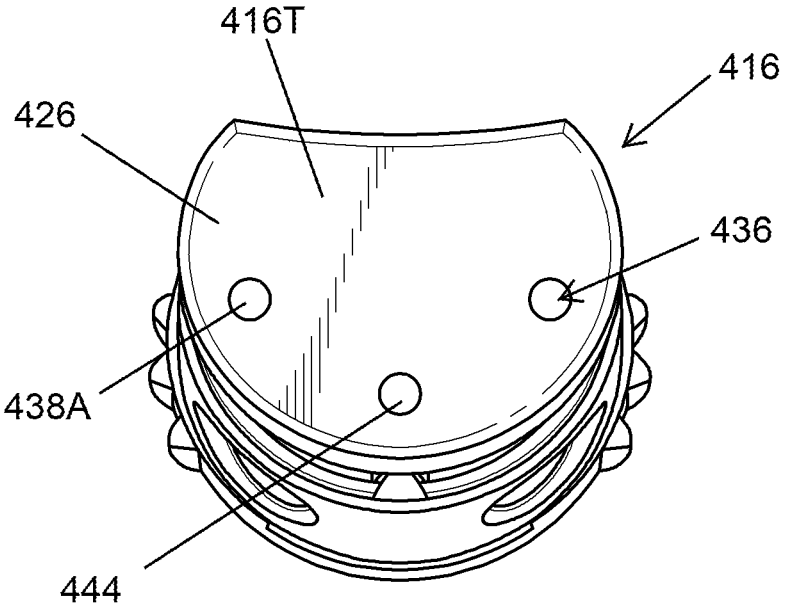
FIG. 4B is a top perspective view of a portion of the lace adjuster of FIG. 4A.

FIG. 4A is an exploded perspective view of a still another embodiment of a lace adjuster 414 having features of the present invention. Additionally, FIG. 4B is a top perspective view of a portion of the lace adjuster 414, i.e. the adjuster assembly 416, illustrated in FIG. 4A. The design of the lace adjuster 414 is substantially similar to the lace adjusters 214, 314 illustrated and described above. For example, the lace adjuster 414 includes an adjuster assembly 416 and a cover 418 that are substantially similar to the adjuster assemblies 216, 316 and the covers 218, 318 illustrated and described above.

However, in this embodiment, the cover attachment assembly 436 again has a different design. In particular, in this embodiment, the first attachment member 438A of the cover attachment assembly 436 includes a plurality of spaced apart cover apertures 444, and the second attachment member 438B includes a plurality of spaced apart cover pins 442. Each of the cover apertures 444 is adapted to receive one of the cover pins 442 when the cover 418 is moved to the attached position. In one embodiment, as illustrated in FIGS. 4A and 4B, the second attachment member 438B, i.e. the cover pins 442, are secured to the bottom surface 418B of the cover 418, and the first attachment member 438A, i.e. the cover apertures 444, are formed into a top surface 416T of the adjuster assembly 416, e.g., a top surface of the inner frame 426 of the adjuster assembly 416.

As shown, the cover 418 includes three cover pins 442 that are substantially evenly spaced apart near a perimeter of the bottom surface 418B of the cover 418, and the adjuster assembly 416 includes three cover apertures 444 that are substantially evenly spaced apart near a perimeter of the top surface 416T of the adjuster assembly 416, e.g., the top surface of the inner frame 426 of the adjuster assembly 416. The cover pins 442 and the cover apertures 444 are positioned to coincide with one another during attachment of the cover 418 to the adjuster assembly 416, i.e. during movement of the cover 418 into the attached position. Alternatively, the cover 418 can include greater than three or less than three cover pins 442, and the adjuster assembly 416 can include greater than three or less than three cover apertures 444. Still alternatively, the cover 418 can be designed to include the plurality of cover apertures 444, i.e. the cover apertures 444 can be formed into the cover 418, and the adjuster assembly 416 can be designed to include the plurality of cover pins 442, i.e. the cover pins 442 can be secured to the top surface 416T of the adjuster assembly 416. Yet alternatively, the cover pins 442 and/or the cover apertures 444 need not be evenly spaced apart and can be positioned other than near the perimeter of the bottom surface 418B of the cover 418 and the top surface 416T of the adjuster assembly 416, respectively.

It should be noted that in certain embodiments, the cover 418 can be used for alternative purposes when not engaged with the adjuster assembly 416. For example, in one non-exclusive alternative embodiment, the cover 418 may include only a single cover pin 442 (although multiple cover pins 442 are also possible), and the cover 418 may be used as a golf ball marker or for other suitable purposes.

While a number of exemplary aspects and embodiments of a lace adjuster 14 have been shown and disclosed herein above, those of skill in the art will recognize certain modifications, permutations, additions and sub-combinations thereof. It is therefore intended that the lace adjuster 14 shall be interpreted to include all such modifications, permutations, additions and sub-combinations as are within their true spirit and scope, and no limitations are intended to the details of construction or design herein shown.

What is claimed is:

1. A lace adjuster for use with a shoe lace of a shoe, the lace adjuster comprising:

an adjuster assembly including a first frame and a second frame that cooperate to securely and adjustably hold the shoe lace of the shoe therebetween;

a first cover that is selectively attachable to the adjuster assembly; and a light assembly including one or more lights that are positioned substantially adjacent to the first cover, wherein power is selectively provided to the light assembly so that at least one or more of the lights generates light that is directed away from the adjuster assembly; and wherein the first frame and the second frame of the adjuster assembly cooperate to securely and adjustably hold the shoe lace of the shoe therebetween even when the first cover is not attached to the adjuster assembly.

2. The lace adjuster of claim 1 further comprising a second cover that is alternatively, selectively attachable to the adjuster assembly.

3. The lace adjuster of claim 1 further comprising a cover attachment assembly that selectively attaches the first cover to the adjuster assembly.

4. The lace adjuster of claim 3 wherein the cover attachment assembly includes a snap.

5. The lace adjuster of claim 3 wherein the cover attachment assembly includes hook and loop material.

6. The lace adjuster of claim 3 wherein the cover attachment assembly includes a plurality of cover pins and a plurality of cover apertures that receive the plurality of cover pins.

7. The lace adjuster of claim 1 wherein the first cover includes a design that is positioned along a top surface of the cover.

8. A first shoe comprising a shoe body, a first shoe lace that is coupled to the shoe body, and the lace adjuster of claim 1 that selectively adjusts the first shoe lace.

9. A lace adjuster for use with a shoe lace of a shoe, the lace adjuster comprising:

an adjuster assembly that securely and adjustably holds the shoe lace of the shoe;

a first cover that is selectively attachable to the adjuster assembly;

a light assembly including one or more lights that are positioned substantially adjacent to the first cover, wherein power is selectively provided to the light assembly so that at least one or more of the lights generates light that is directed away from the adjuster assembly; and a cover attachment assembly that selectively attaches the first cover to the adjuster assembly, wherein the cover attachment assembly includes hook and loop material.

10. A lace adjuster for use with a shoe lace of a shoe, the lace adjuster comprising:

an adjuster assembly that securely and adjustably holds the shoe lace of the shoe;

a first cover that is selectively attachable to the adjuster assembly;

a light assembly including one or more lights that are positioned substantially adjacent to the first cover, wherein power is selectively provided to the light assembly so that at least one or more of the lights generates light that is directed away from the adjuster assembly; and a cover attachment assembly that selectively attaches the first cover to the adjuster assembly, wherein the cover attachment assembly includes a plurality of cover pins and a plurality of cover apertures that receive the plurality of cover pins.

11. The lace adjuster of claim 10 wherein the first cover includes the plurality of cover pins and the adjuster assembly includes the plurality of cover apertures.

12. A lace adjuster for use with a shoe lace of a shoe, the lace adjuster comprising:

an adjuster assembly including a first frame and a second frame that cooperate to securely and adjustably hold the shoe lace of the shoe therebetween;

a first cover that is selectively movable between (i) an attached position, wherein the first cover is attached to the adjuster assembly, and (ii) a detached position, wherein the first cover is detached from the adjuster assembly; and a light assembly including one or more lights that are positioned substantially adjacent to the first cover, wherein power is selectively provided to the light assembly so that at least one or more of the lights generates light that is directed away from the adjuster assembly; and wherein the first frame and the second frame of the adjuster assembly cooperate to securely and adjustably hold the shoe lace of the shoe therebetween when the first cover is in each of the attached position and the detached position.

13. The lace adjuster of claim 12 wherein the first cover is movable between the attached position and the detached position without damaging the first cover and the adjuster assembly.

14. The lace adjuster of claim 12 further comprising a second cover that is selectively movable between an attached position and a detached position without damaging the second cover and the adjuster assembly, wherein when the second cover is in the attached position, the second cover is attached to the adjuster assembly, and wherein when the second cover is in the detached position, the second cover is detached from the adjuster assembly.

15. The lace adjuster of claim 12 further comprising a cover attachment assembly including a first attachment member that is secured to the adjuster assembly and a second attachment member that is secured to the first cover, wherein the first attachment member engages the second attachment member when the first cover is in the attached position, and wherein the first attachment member does not engage the second attachment member when the first cover is in the detached position.

16. The lace adjuster of claim 15 wherein the cover attachment assembly includes a snap.

17. The lace adjuster of claim 15 wherein the cover attachment assembly includes hook and loop material.

18. The lace adjuster of claim 15 wherein the cover attachment assembly includes a plurality of cover pins and a plurality of cover apertures that receive the plurality of cover pins.

19. The lace adjuster of claim 12 wherein the first cover includes a design that is positioned along a top surface of the cover.

20. A first shoe comprising a shoe body, a first shoe lace that is coupled to the shoe body, and the lace adjuster of claim 12 that selectively adjusts the first shoe lace.

* * * * *